United States Patent [19]

Holden

[11] Patent Number: 4,890,745

[45] Date of Patent: Jan. 2, 1990

[54] DISPLAY HOLDER FOR EYEGLASSES

[76] Inventor: W. Bruce Holden, 500 Cohasset Rd. Suite 34, Chico, Calif. 95926

[21] Appl. No.: 273,905

[22] Filed: Nov. 21, 1988

[51] Int. Cl.[4] ..... A47F 7/00

[52] U.S. Cl. ..... 211/13; 248/205.2; 248/902

[58] Field of Search ..... 211/87, 13, 89; 248/DIG. 2, 205.2

[56] References Cited

U.S. PATENT DOCUMENTS

| | | | |
|---|---|---|---|
| 2,467,251 | 6/1947 | Bowman . | |
| 3,229,944 | 3/1964 | Everburg . | |
| 3,259,348 | 7/1966 | Dann | 211/13 X |
| 4,128,224 | 12/1978 | Guichard . | |
| 4,239,167 | 12/1980 | Lane | 248/DIG. 2 |
| 4,558,788 | 12/1985 | Grothaus . | |
| 4,702,451 | 10/1987 | Salazar et al. . | |
| 4,724,966 | 2/1988 | Benaksas | 248/DIG. 2 X |
| 4,787,520 | 11/1988 | Pearson | 248/DIG. 2 |

*Primary Examiner*—Robert W. Gibson, Jr.

[57] ABSTRACT

Semicircular arches cut in angled sides of the flat trapezoidal shaped platform of a display eyeglass holder are sized to maintain a pair of eyeglasses in an in-use position with the temples folded and unfolded. The eyeglass supporting end of the holder platform is narrowed and obstructs minimal surface area of the bridge and lenses providing a more complete viewing of the displayed eyeglasses. The holder is attachable, both removably and permanently, to a variety of display stands and support surfaces.

7 Claims, 6 Drawing Sheets

DISPLAY HOLDER FOR EYEGLASSES

BACKGROUND OF THE INVENTION

1. Field of the Invention

This invention relates to holders for displaying eyeglasses. More precisely, the present invention is directed towards a horizontal bridge and nose pad support allowing clear view of the glass frame with the temples extended and with the temples folded.

2. Description of the Prior Art

A wide variety of eyeglass holders and supports for display purposes have been known for some time. The majority of these devices require the temple portion of the eyeglass to be supported in conjunction with the bridge. In a few devices, a bridge supporting structure which alone maintains the eyeglasses in a horizontal and in a use position are seen in past art patents examined. These devices however do not accomplish the same objective as my invention which provides a simple and low cost holder reducing visual obstruction which obscure full viewing of the lenses and frame of the displayed glasses. For example, Grothaus, U.S. Pat. No. 4,558,788, discloses a positionable bridge supporting device movably attached to a cylindrical rod. The bridge supporting structure covers a good deal of the lens of the eyeglasses, preventing the viewer from seeing it clearly. Bowman, U.S. Pat. No. 2,467,251 and Reinalter, Swiss Pat. No. 415,105, both show eyeglass supports which are attachable by suction cup to a flat surface. The Bowman support and the Reinalter support both would obstruct the bridge portion of the glasses. Guichard, U.S. Pat. No. 4,128,224, shows a device having an adjustable bridge support which would be extremely costly to manufacture in comparison to my device, and again, the bridge support covers more of the eyeglass than does my invention. Salazar, Jr. et al in U.S. Pat. No. 4,702,451 discloses a device designed to support eyeglass in a folded position only. Everburg, U.S. Pat. No. 3,229,944, displays the eyeglasses at an angle to the support surface. Viewers are required to stand to one side of the display area to view the glasses from the front.

To my knowledge, the foregoing patents represented devices most pertinent to my invention. Although eyeglass supports are necessarily somewhat similar, none provide a cost effective holder or support which obstructs as little of the surface area of the eyeglasses as does my device. As is shown in the following specification, my invention is a simplified holder which is a significant improvement over existing holders for supporting displayed eyeglass and sunglasses.

SUMMARY OF THE INVENTION

In practicing my invention I have developed a very simple and inexpensive holder for displaying eye wear in an opened and in a folded position without the holder covering a large area of the bridge and lens section. The holder is formed as a short flattened member with horizontally inclined surfaces and having exposed narrow vertical edges. The flattened member, hereinafter called holder, is quadrilateral having a substantially trapezoidal shape. A short side parallels a long side and there are two angled sides of equal length. The short side is the front edge of the glasses supporting end. The long side is the attachment end and is the end where the back edge attaches to a support surface and to a base which is attachable to a support surface. Two parallel semicircular notches are cut one in each angled side of the holder. The notches are sized to accept and hold both the nose tab and nose pad type of nose rests used on a variety of glasses. The holder is structured to maintain the displayed glasses with the temples folded and unfolded without requiring additional support for the temples and to provide an unobstructed view of both lenses and frames. It is to be noted that my holder is not meant to be useful individually but is designed for use as an iatrical part of a variety of vertical supporting stands and for permanent and removable attachment to various vertically inclined surfaces. In use, my holder is mounted on a stand with wider surfaces horizontally aligned. The nose section of the eyeglasses is centered over the holder with the bridge resting on the upper holder surface. The nose pads are positioned in the semicircular notches. The lenses are vertical and the front of the glasses are faced towards the short side, the front edge of the holder, which is the glasses supporting end. Where glasses might normally have to be displayed with temples unfolded, the temples can also be displayed folded in behind the glasses when my holder is in use. My holder is ideal for use on narrow support stands in both single and multiple displays. In some applications, a perpendicular base affixed to the back edge of the holder allows removable attachment by hook and loop surfaces and by screw fittings to a supporting surface. For permanence, my holder can be manufactured as an integral part of a display stand and is applicable for fastening to a display surface during manufacturing. The holder can also be fastened by adhesive material. In plastic structures, the holder can be attached to the display surface by welds.

My holder works well as an integral iatrical part of a particular one-piece display stand. The stand, preferably of plastic, is a flattened Z-shaped substantially triangular structure. The bottom of the Z is widened into a base and the top of the Z is narrowed into the shape of my holder. The holder is also useful in multiple applications one above the other in narrow holders with single supports and in multiple applications where the holder is attached to a flat supporting surface. On flat surfaces, provisions are normally made for the unfolded temples to pass through apertures cut in the surfaces for the purpose. In applications where the base of my holder is removably fastened to the supporting surface by hook and loop style fasteners, variable arrangement of the number and position of the eyeglasses on the display stand can be accomplished.

Therefore, it is a primary object of my invention to provide a bridge support for eye wear which can support eyeglasses in both an opened or folded position.

Another object of my invention is to provide a bridge support for eye wear which does not obstruct an appreciable amount of the frame or lens.

A further object of my invention is to provide a bridge support for eye wear which is very simple and cost effective to produce.

An even further object of my invention is to provide a bridge support for eye wear which can be adapted to single display stands and to various multiple unit display cases.

Further objects and advantages of my invention will be better understood on reading the ensuing description with reference to the accompanying numbered drawings in which.

DESCRIPTION OF THE PREFERRED EMBODIMENT

Figure 1:
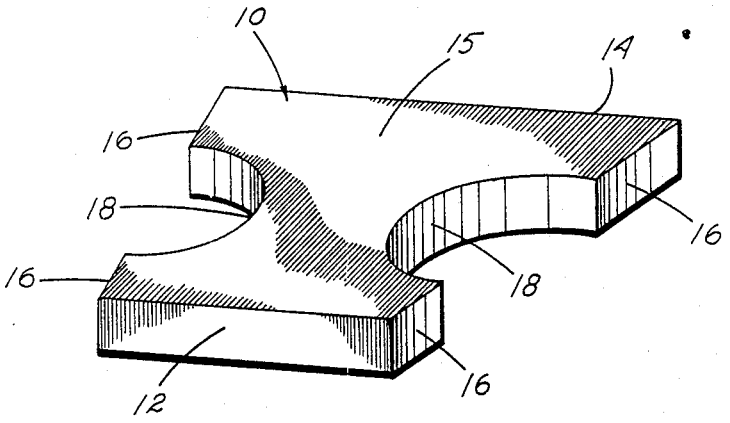
FIG. 1 illustrates the platform structure of the holder in a perspective view horizontally aligned with the top surface upwardly and the front edge predominately displayed.
Figure 2:
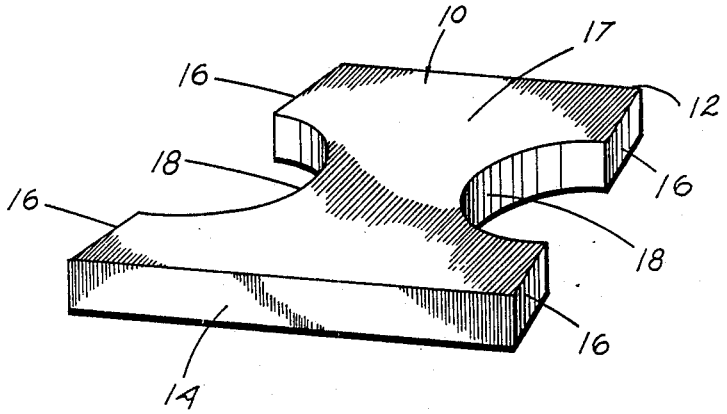
FIG. 2 shows the holder platform structure of FIG. 1 in a perspective view with the bottom surface upwardly and the back edge predominantly displayed.
Figure 3:
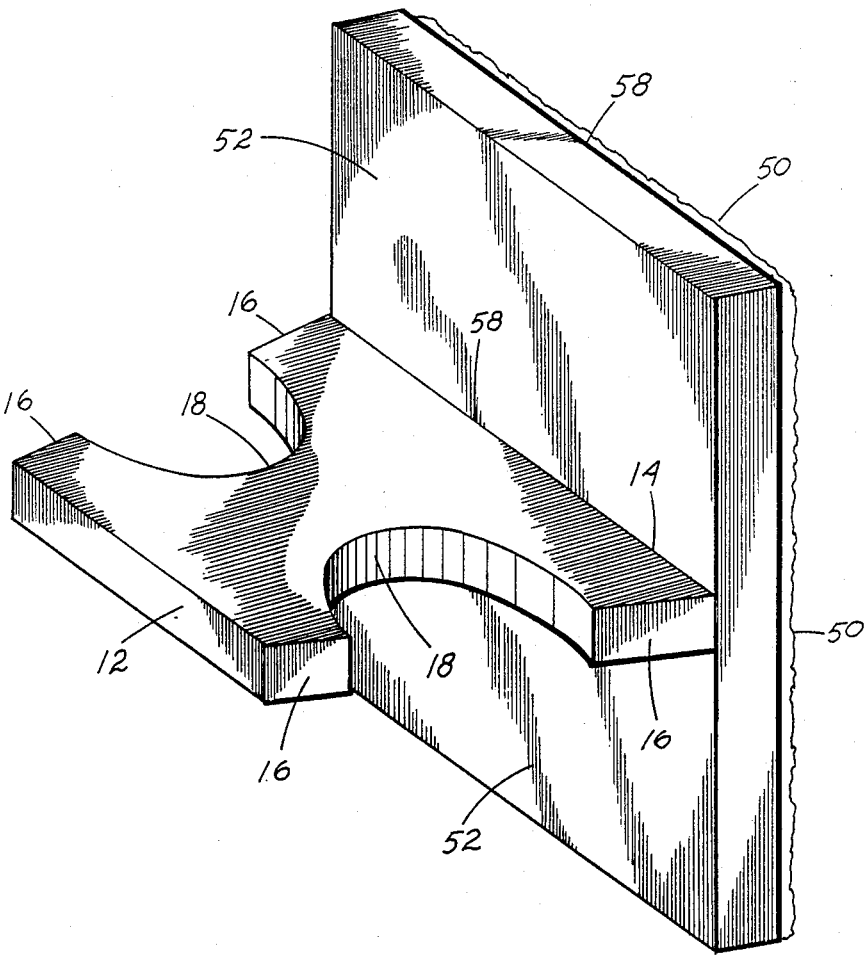
FIG. 3 is a perspective view of the holder platform affixed perpendicularly to an attachment base illustrating weld and adhesion areas and hook and loop fasteners on the back side of the attachment base.
Figure 6:
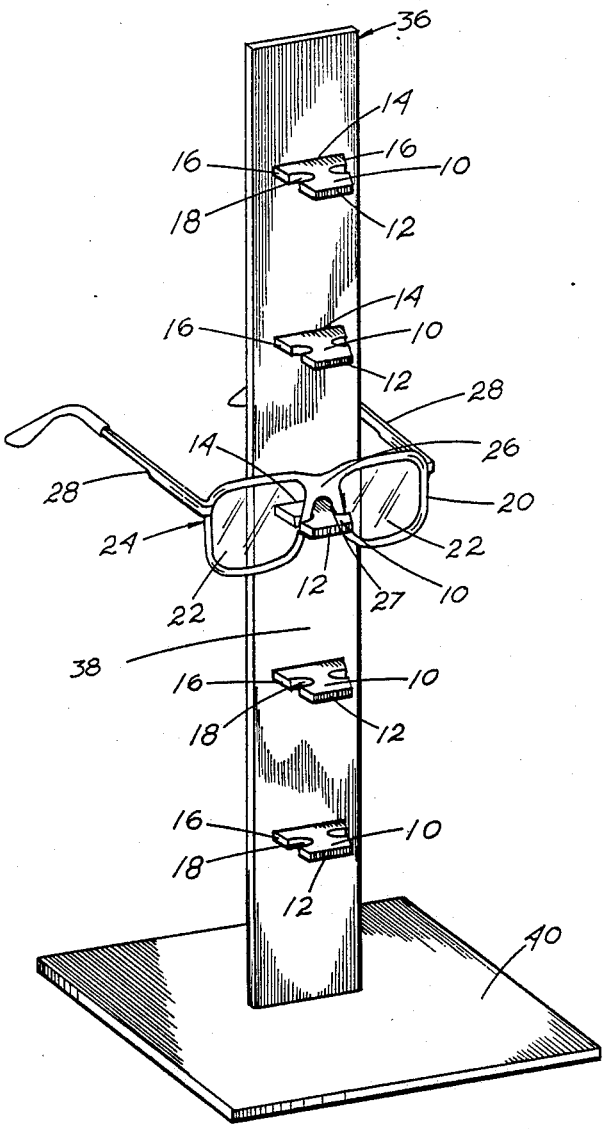
FIG. 6 is a perspective in use illustration of holders attached one over the other on a single support display stand.
Figure 7:
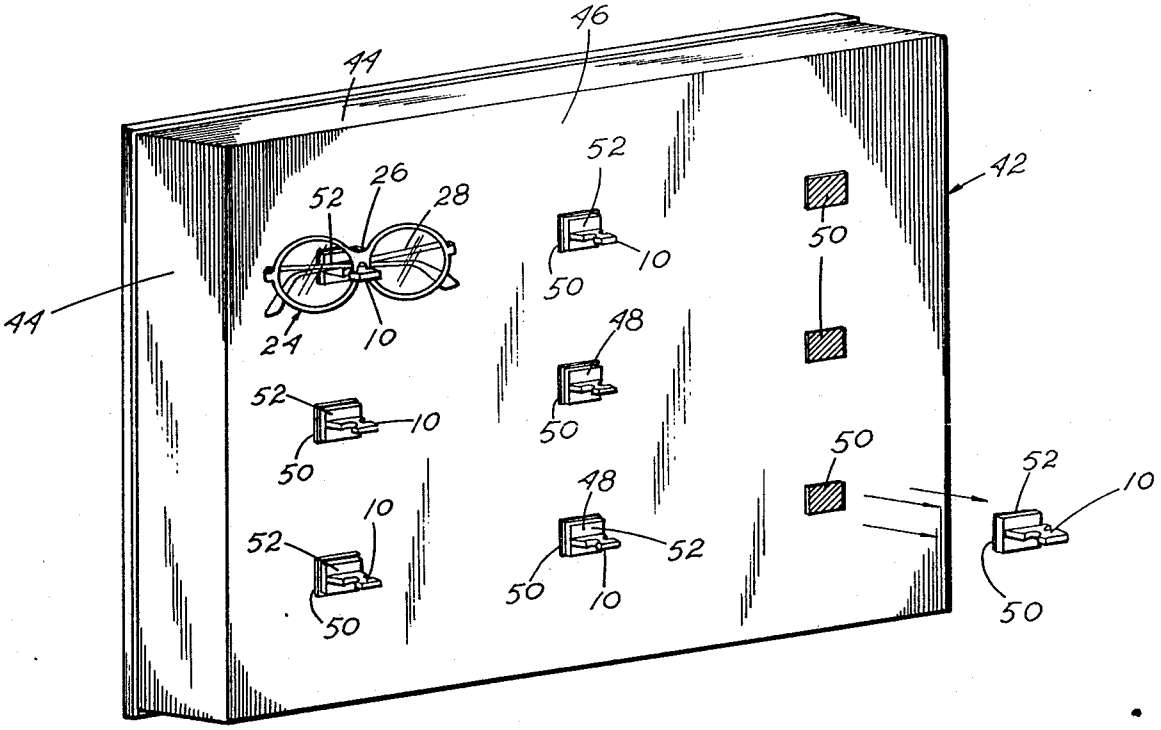
FIG. 7 is a perspective in use illustration of the holder platform affixed with an attachment base having loop and hook attachment and detachment features. The glasses are illustrated with temples folded.
Figure 8:
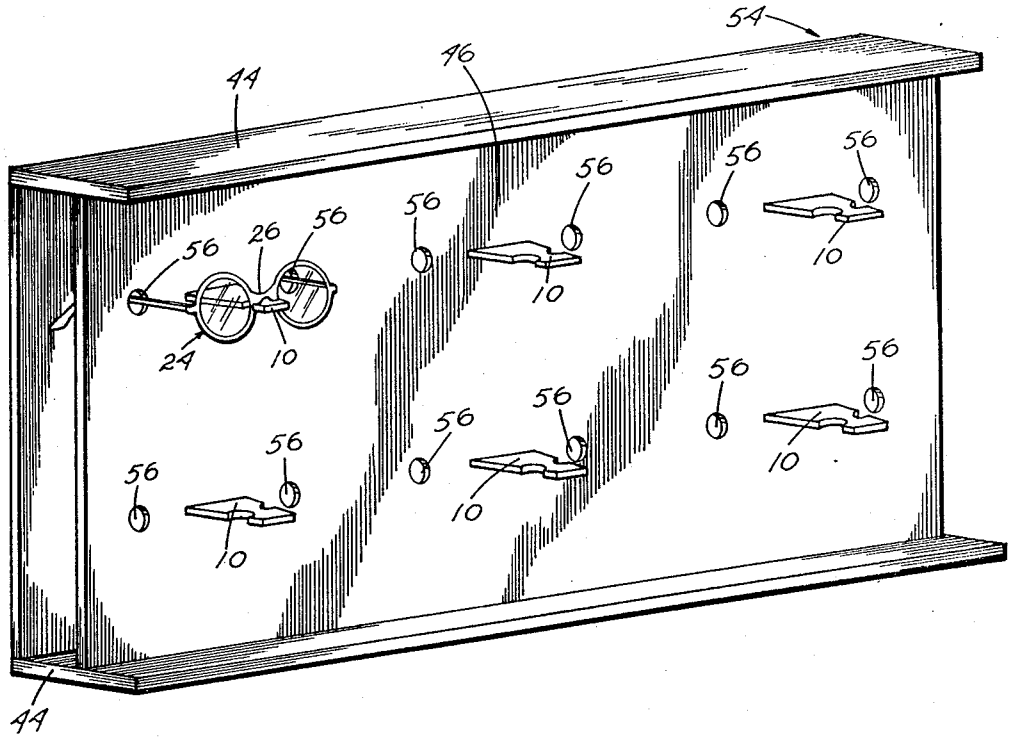
FIG. 8 is a perspective in use illustration of the holder permanently affixed to a support surface with the support surface apertured so the glasses can be displayed with the temples unfolded.

Referring now to the drawings where the display holder for eyeglasses of this invention is shown structurally in the form of platform 10 which is illustrated singularly and affixed to various supporting fixtures. Platform 10, shown perspectively in FIG. 1 and FIG. 2, is a short flattened quadrilateral structure having wide surfaces horizontally disposed and narrow surfaces vertically disposed as exposed narrow vertical edges. The horizontal surfaces include top surface 15 normally faced upwardly and bottom surface 17 normally faced downwardly. The shape of platform 10 is substantially trapezoidal with a short side, front edge 12, paralleling a long side, back edge 14, and two angled sides 16 of equal length. Two parallel semicircular notches 18, cut one in each of the angled sides 16 of platform 10, curve inwardly towards each other centrally in platform 10. Semicircular notches 18 are sized to accept and hold curved nose rests 27 of eyeglasses 24. For display, the front of eyeglasses 24 face front edge 12 which is the terminal eyeglasses supporting end of platform 10. Back edge 14 is the end where platform 10 attaches to single unit display stand 30, to vertical support surface 38, to front display panel 46, and to a perpendicular attachment base 52. Attachment base 52 shown in FIG. 3 and FIG. 7 makes platform 10 into a removable bridge support 48 (FIG. 7) which can be removably attachable to multiple removable unit case 42 by hook and loop type fasteners 50. In FIG. 7, multiple removable unit case 42 has a frame 44 and a front display panel 46 on which eyeglasses 24 can be displayed with temples 28 folded. Platform 10 attached by hook and loop style fasteners 50 can be removed and repositioned. Multiple removable unit case 42 illustrates a transportable display unit which can be carried in a brief case and used as a counter display. Although platform 10 is structured to maintain displayed eyeglasses 24 without requiring additional support for temples 28 folded and unfolded, for displaying eyeglasses 24 on frontal display panel 46 with temples 28 unfolded, temple apertures 56 are required. This condition is shown in FIG. 8 where multiple unit display case 54 is illustrated. On multiple unit stand 36, shown in FIG. 6, where a base stand 40 supports a narrow vertical support surface 38, eyeglasses 24 with eyeglass bridge 26 on top of platform 10 and nose pads 27 in semicircular notches 18, frame 20 and lenses 22 are positionally maintained and unobstructively displayed with temples 28 unfolded.

Figure 4:
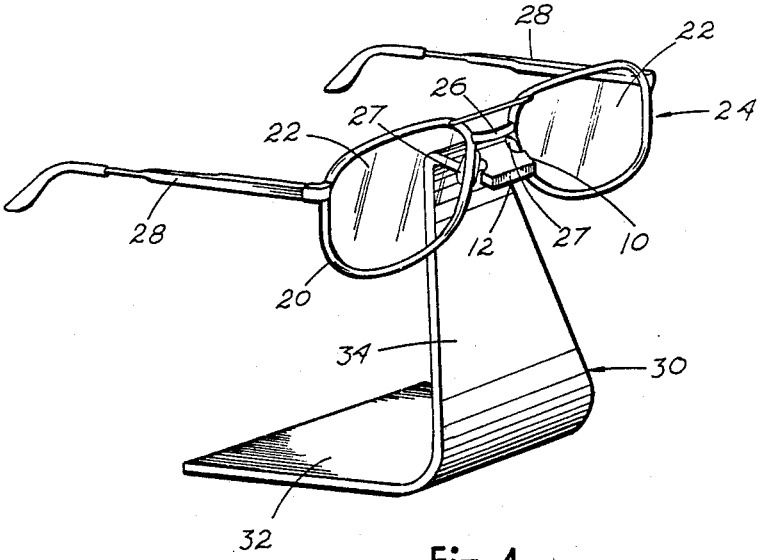
FIG. 4 is a perspective in use illustration of the holder platform manufactured as an integral part of a one-piece Z-shaped display stand.
Figure 5:
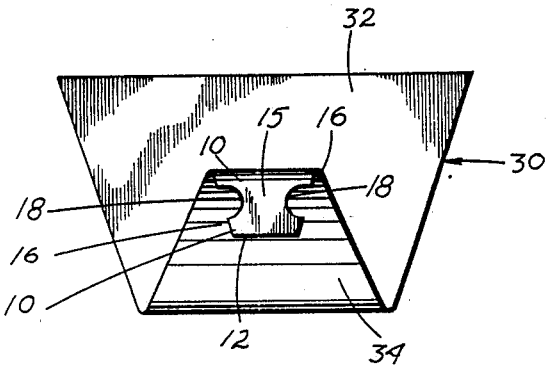
FIG. 5 is a top plan view of the holder platform as part of the one-piece display stand of FIG. 1.

Platform 10 as illustrated in FIG. 4 and FIG. 5 is uniquely useful as an integral part of a single unit display stand 30. Single unit display stand 30 is substantially Z-shaped having a flattened horizontally inclined support base 32 continuing on into an upwardly angled arm 34 and angling horizontally into platform 10 as a one-piece stand, single unit display stand 30.

In use, platform 10 is mounted, for example, on a display stand having a front display panel 46 as illustrated in FIG. 7 and FIG. 8. Platform 10 is affixed to front display panel 46 removably by hook and loop style fasteners 50 as shown in FIG. 7. Platform 10 as an integral part of the display stand as shown in FIG. 4 and FIG. 5. Platform 10, depending upon the application, can be permanently affixed to the supporting structure surface along weld and adhesive area 58 to the display devices shown in FIG. 6 and FIG. 8. Welds are normally used to attach plastic to plastic, the preferred material for the manufacturing of platform 10. Platform 10 is mounted horizontally with top surface 15 upwardly, bottom surface 17 downwardly, back edge 14 attached, and front edge 12 free. Eyeglass bridge 26 rests on top surface 15 and nose pads 27 are positioned in the semicircular notches 27. Frame 20 and lenses 22 are vertical and the front of the eyeglasses 24 are faced towards front edge 12 for display purposes. In this position, eyeglasses 24 are free of visual obstructions and frames 20, lenses 22, and temples 28 folded and unfolded can be easily fully examined.

Although an embodiment of the invention has been described in specific terms in the foregoing specification, it will be understood that the invention may be embodied in other specific forms without departing from the spirit or principal characteristics of the invention. The description, therefore, is to be considered in all respects as illustrative and not restrictive, and the invention is not to be limited to the details given herein.

What I claim is:

1. A display holder for eyeglasses, comprising:

a platform;

said platform sized to support a single pair of eyeglasses at the bridge area;

said platform being a flattened quadrilateral structure substantially trapezoidal shaped;

said platform having wide surfaces horizontally disposed and narrow surfaces vertically disposed with said narrow surfaces being exposed vertical edges thereof, said platform, said quadrilateral structure thereof, including a short side paralleling a long side and two sides of equal length angled from said short side to said long side;

eyeglasses retaining means;

said eyeglasses retaining means being parallel semicircular notches cut one in each said angled side of said platform;

said notches sized to accept eyeglass nose rests and hold said eyeglasses firmly in display attitude, temples folded and temples unfolded, with said platform affixed along said long side, said vertical edge thereof, perpendicularly to a supporting structure;

means for attaching said platform to said supporting structure.

2. The display holder for eyeglasses of claim 1 wherein the material for manufacturing said holder, said platform thereof, is a plastic composition.

3. The display holder for eyeglasses of claim 1 wherein said means for attaching said platform to said supporting structure being manufacturing said platform as an integral part of said supporting structure.

4. The display holder for eyeglasses of claim 1 wherein said means for attaching said platform to said supporting structure being attachment by an adhering agent.

5. The display holder for eyeglasses of claim 2 wherein said means for attaching said platform to said supporting structure comprises welding.

6. The display holder for eyeglasses of claim 1 wherein said means for attaching said platform to said supporting structure being said platform affixed perpendicularly with a substantially rectangular flattened attachment base and said attachment base on the free wide surface side thereof affixed with hook and loop style fasteners compatible with hook and loop style fasteners affixed to said supporting structure for removable attachment thereof.

7. The display holder for eyeglasses of claim 1 wherein said means for attaching said platform to said supporting structure being said platform affixed perpendicularly with a substantially rectangular flattened attachment base and said attachment base on the free wide surface side thereof being a weld and adhesion area.

* * * * *